United States Patent [19]

Miner et al.

[11] 4,316,593

[45] Feb. 23, 1982

[54] COMBINATION CONNECTING PLATE

[76] Inventors: Kevin S. Miner, 11794 Inverness Cir.; Abraham Trachtenberg, 167 Forrester Ct., both of West Palm Beach, Fla. 33411

[21] Appl. No.: 87,579

[22] Filed: Oct. 22, 1979

[51] Int. Cl.[3] ..... A47G 29/02

[52] U.S. Cl. ..... 248/250; 211/90; 403/384

[58] Field of Search ..... 248/250, 558; 403/384; 211/182, 90; 108/152

[56] References Cited

U.S. PATENT DOCUMENTS

| | | | |
|---|---|---|---|
| 400,296 | 3/1889 | Brott | 403/384 |
| 469,808 | 3/1892 | Poindexter | 403/384 |
| 758,910 | 5/1904 | Grattelo | 403/384 |
| 3,765,634 | 10/1973 | Stempel | 248/250 |
| 4,138,079 | 2/1979 | Ehret | 248/558 |

*Primary Examiner*—J. Franklin Foss
*Attorney, Agent, or Firm*—Malin & Haley

[57] ABSTRACT

A single connecting plate useful for joining wall-mounted shelf support brackets together with ventilated metal closet shelves of different sizes. The connecting plate is adaptable to fit two different sized closet shelves, depending upon the orientation of the longitudinal axis of the connecting plate relative to the leading edge of the different shelves. The connecting plate, which attaches to the outwardly extended end of a wall-mounted, shelf supporting bracket, couples the front edge of the rails of the shelf to the bracket. The connecting plate includes pairs of recessed portions along each edge which are sized to receive the rail of the different shelves, the distance between the recessed portions on the plate edges being a function of the distance between the leading edge rails of the shelf.

2 Claims, 8 Drawing Figures

COMBINATION CONNECTING PLATE

BACKGROUND OF THE INVENTION

This invention relates to a connecting plate that is used to join a bracket to conventional vinyl covered metal shelving having a front vertical edge defined by two parallel rods or rails. Such metal shelving has become popular and is often installed in closets and other areas by mounting the shelving to a wall with a wall-mounted bracket that is coupled with a connecting plate to the front vertical leading edge of the shelf. Conventionally, two types of shelves are presented, one which provides for an additional or larger leading edge having a rail for mounting hangers and the like, and one that is not adapted to that use which has a smaller width along its leading edge. To date, two different connecting plates have been employed because of the different sizes along the leading edges of the shelves, depending on the particular unit. This requires the inventory and the manufacture of two separate products.

The present invention eliminates the need for two separate connecting plates by providing in a single plate one that can be used with either shelf. Thus, applicant's invention reduces the manufacture costs and the necessity of stocking two different items.

An example of a conventional face plate is shown in U.S. Pat. No. 3,765,634.

BRIEF DESCRIPTION OF THE INVENTION

A connecting plate that is used to join together either of two metal shelves having vinyl covered rod construction to a wall-mounted shelf supporting bracket.

The connecting plate is comprised of a flat, rectangular, planar surface having a peripheral wall disposed at approximately a ninety degree angle to the flat, rectangular surface.

The peripheral wall structure is essentially two pairs of wall segments parallel to each other disposed along the longer and shorter rectangular sides of the flat surface. Within each wall segment is a pair of spaced apart grooves which are sized to snuggly receive the rod members along the front edge of the metal shelving. Opposite parallel wall segments have the same separation distance between the shelf rod grooves. The groove separation distance along the shorter sides is different than along the longer sides to accommodate the difference in the leading edge rod separation in the different shelves.

The center of the connecting plate includes a raised cylindrical boss having a channel through the plane of the plate for receiving a threaded connector such as a bolt that attaches the plate to the extended end of the wall bracket with a nut. The flat, raised face of the boss fits flush against the end of the wall bracket for increased support.

The connecting plate has on the same side as the peripheral walls additional short wall segments which form criss-crossing channels aligned along the axial direction of the opposing grooves for additional support of the plate against the leading edge metal rods of the shelf. These make the plate fit tighter and provide for more rigid support.

To utilize the present invention, either type of shelf is selected for mounting on the wall. Depending upon the particular size of the leading edge of the shelf, the connecting plate is positioned with its longitudinal axis relative to the leading edge of the shelf in one of two directions, which are ninety degrees to each other, such that the grooves in the peripheral wall perfectly match the distance between the leading edge rods of the selected shelf. The connecting plate is then snapped into the shelf and a threaded connector positioned through the connecting plate which is attached on the inside surface to one end of a wall mounted bracket. For a different sized shelf, the connecting plate is merely rotated ninety degrees relative to its longitudinal axis and mounted in a similar manner.

It is an object of this invention to provide a connecting plate for a wall-mounted shelf bracket that is adapted to fit two different sized metal rail shelves.

It is another object of this invention to provide a single, universal connecting plate that can be used with two different sized metal wall-mounted shelves, eliminating the need for two different sized plates, without reducing the structural integrity of the bracket and shelf mount.

In accordance with these and other objects which will be apparent hereinafter, the instant invention will now be described with particular reference to the accompanying drawings.

PREFERRED EMBODIMENT OF THE INVENTION

Figure 1:
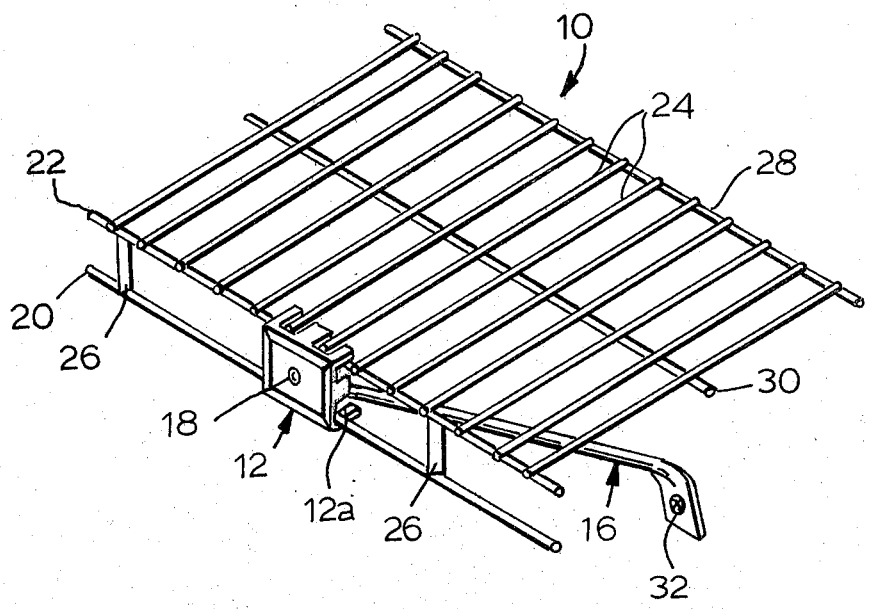
FIG. 1 shows a perspective view of a conventional vinyl covered metal wall mounted shelf of a particular size with the present invention installed therein.
Figure 4:
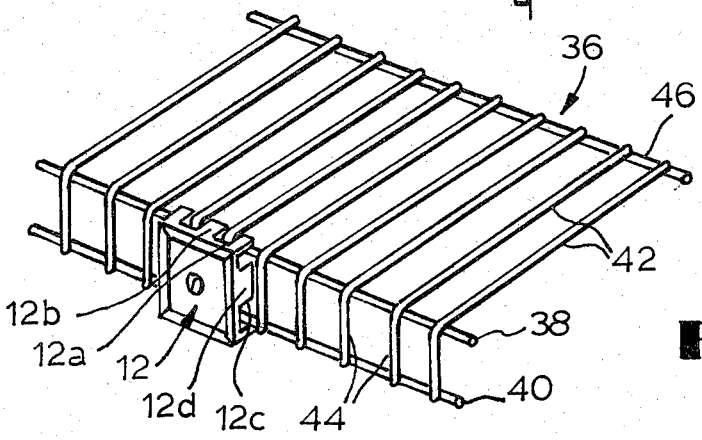
FIG. 4 shows the same plate used in FIG. 1 in a perspective view installed on a different size shelf from that shown in FIG. 1.

Referring now to the drawings and especially FIGS. 1 and 4, the present invention 12 is shown mounted on two different sized shelves 10 and 36 respectively. The fundamental difference between shelf 10 and shelf 36 is the spacing distance between leading edge rods 20 and 22 when compared to leading edge rods 38 and 40. To accomplish mounting of the connecting plate 12 as between the shelf 10 of FIG. 1 and shelf 36 of FIG. 4, the connecting plate body is rotated ninety degrees such that the lateral sides of the plate 12 span the rod spacing of rods 20 and 22 in FIG. 1, while the longitudinal sides of plate 12 span the rod spacing of rods 38 and 40 in FIG. 4.

Referring now to FIG. 1, the present invention is shown generally at 12 attached to a metal, wall-mounted shelf 10, which is one standard size of shelving. The shelf is comprised essentially of a plurality of parallel rods 24 which are welded to end and middle supporting rods 28 and 30. The shelf further includes a forward vertical edge comprised of parallel rods 20 and 22 connected to supporting rods 26 therebetween. The shelf 10 and the bracket 16 are conventional. The bracket 16 is mounted at one end to the wall by a threaded connector 32.

The present invention 12, which is a connecting plate, is utilized as a connector between the bracket 16 and the shelf 10. A channel through center of the connecting plate 12 receives a bolt 18 to allow it to be connected to the bracket 16.

The connecting plate is mounted on the front vertical edge of the shelf formed by parallel rods 20 and 22.

Figure 2:
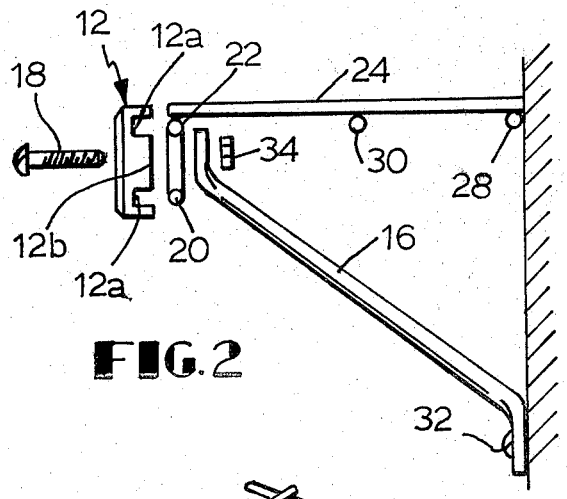
FIG. 2 shows a side exploded view of the present invention with respect to the conventional shelf and wall bracket.
Figure 3:
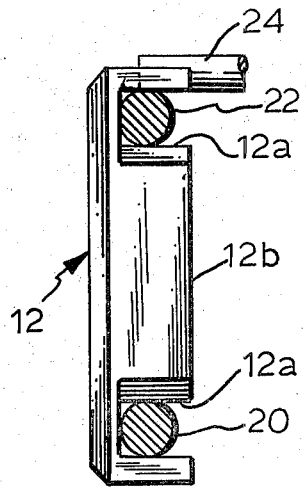
FIG. 3 shows a side fragmentary elevational view, partially in cross section, of the present invention mounted on the leading edge of a shelf.

FIGS. 2 and 3 show how the mounting of the plate 12 is accomplished on the shelf of FIG. 1. The plate 12 has lateral sides that are sized to fit across rods 20 and 22; each plate lateral side including a central side wall portion 12*b*, and a pair of recessed grooves 12*a*, the grooves being spaced apart from each other a distance equal to the distance between the front edge rods 20 and 22 shown in the first standard model observed in FIG. 1. The size of the grooves 12*a* are such to accommodate the rod diameter of rods 20 and 22 for a snug fit onto the rods. The connecting plate 12 is mounted with its flat surface outward, the rods 20 and 22 are firmly secured within grooves 12*a* (on each lateral side). As shown in FIG. 2, the bolt 18 is connected to a nut 34 when the connecting plate is mounted in place, securely holding the bracket 16 to the forward leading edge of the shelf 10.

FIG. 4 shows a different model self with a forward leading edge having rods 38 and 40 which are spaced apart a greater distance than the shelf model shown in FIG. 1. (In conventional shelving applications, different connecting plates have been used of necessity when connecting the shelf shown in FIG. 1 to a bracket compared to the shelf shown in FIG. 4.) However, to mount the present invention on the shelf as shown in FIG. 4, the plate 12 is rotated ninety degrees (from the position shown in FIG. 1) relative to its longitudinal axis and is mounted on the front edges with its longitudinal (longer) sides connected across rods 38 and 40. The longitudinal sides include a central wall portion 12*d* defined by grooves 12*c*, the distance between the grooves 12*c* on each longitudinal side being equal to the distance between leading edge rods 38 and 40. Each groove 12*c* is sized to fit snuggly with rods 38 and 40.

Figure 5:
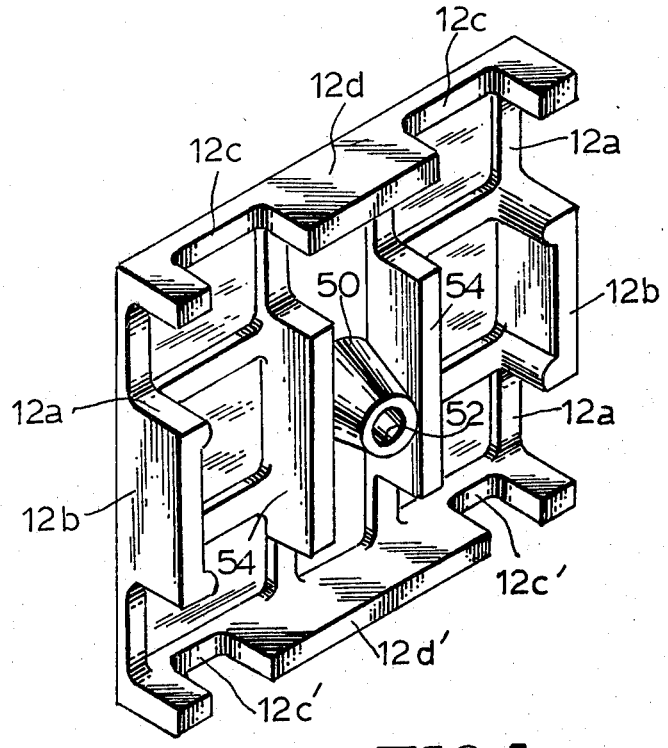
FIG. 5 shows the inside face of the present invention in a perspective view.

FIG. 5 shows the inside face of plate 12 that includes additional wall segments 54 which form interior channels for additional strength, the walls 54 including a top surface portions which in conjunction with cylindrical boss 50 (having a channel 52 therein that receives the threaded bolt 18) allows the bracket flat end portion to firmly rest against the top surfaces of the wall segments 54 and boss 50. This makes for a much more rigid connection regardless of which direction the plate is oriented relative to the bracket.

In summary, as shown in FIG. 5, the distance between the recessed grooves 12*a* on each lateral wall is equal to the leading edge rod spacing (rods 20 and 22, FIG. 1) in one particular model of shelf, while the distance between grooves 12*c* on each longitudinal wall is larger to accommodate a different size shelf leading edge rod spacing (rods 38 and 40, FIG. 4).

Figure 6:
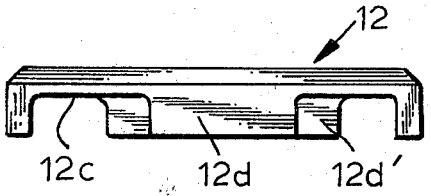
FIG. 6 shows a top plan view of the present invention as shown in FIG. 5.
Figure 7:
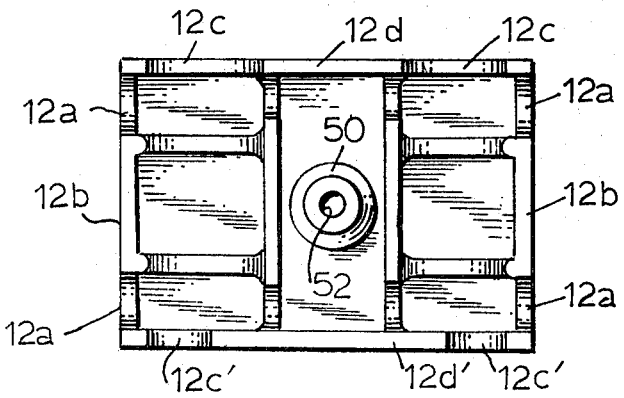
FIG. 7 shows a front elevational view of the inside surface of the present invention.
Figure 8:
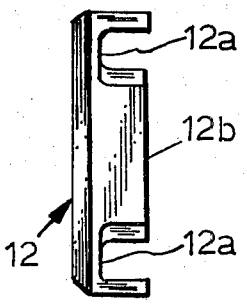
FIG. 8 shows an end elevational view of the present invention as shown in FIG. 5.

FIGS. 6, 7, and 8 show the spacial relationships between the recessed grooves formed in the plate peripheral side walls, the interior walls, and the central boss. Wall structure 12*b* is shown to be slightly smaller than wall structure segment 12*b'*, even though the outer limits of the recessed grooves 12*c* are identically spaces which is necessitated by the spacing between the upper rods 24 (FIG. 1) of the shelving so that the connecting plate can fit along its upper wall between the rods 24.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A connecting means for attaching a supporting bracket to shelving, said shelving having different size members, said connecting means comprising:

a plate;

said shelving having at least a first pair of parallel members, a second pair of parallel members and a third pair of parallel members, said second pair of parallel members transversely connectable to said first pair of parallel members and a third pair of parallel members, having a greater distance therebetween than said second pair of parallel members, said third pair of parallel members transversely connectable to said first pair of parallel members;

said plates having a first pair of receiving groove means for receiving said first and second pairs of parallel members and a second receiving groove means for receiving said second and first pairs of parallel members, said first pair of receiving groove means for receiving said first pair of parallel members when said second pair of parallel members is disposed in said second pair of receiving groove means and for receiving said third pair of parallel members when said first pair of parallel members is disposed in said second pair of receiving groove means and said second pair of receiving groove means for receiving said second pair of parallel members when said first pair of parallel members is disposed in said first pair of receiving groove means and for receiving said first pair of parallel members when said third pair of parallel members is disposed in said first pair of receiving groove means, and a means for fastening said plate to said supporting bracket.

2. A connecting means as in claim 1, wherein:

said plate includes a side having additional protruding wall segments with top surfaces forming said first and second pairs of receiving groove means; and a central boss having a channel disposed therethrough and an upper boss top surface disposed in proximite to said additional wall segment's top surfaces, said upper wall surfaces and said boss upper surface lying in a common flat plane engageable against the flat surface of said mounting bracket.

* * * * *